US005937449A

United States Patent [19]

Rey

[11] Patent Number: 5,937,449

[45] Date of Patent: Aug. 17, 1999

[54] TOILET SEAT COVER WITH GRAVITY LATCH

[76] Inventor: Jorge E. Rey, 125 NW. 7th Ave., Apt. No. 2, Miami, Fla. 33128-1535

[21] Appl. No.: 08/926,725

[22] Filed: Sep. 10, 1997

[51] Int. Cl.[6] ..... A47K 13/10

[52] U.S. Cl. ..... 4/246.1

[58] Field of Search ..... 4/242.1, 246.1, 4/246.3, 246.4, 246.5

[56] References Cited

U.S. PATENT DOCUMENTS 723,973 3/1903 Alexander ..... 4/246.1 X

FOREIGN PATENT DOCUMENTS 44069 6/1908 Switzerland ..... 4/246.3

*Primary Examiner*—Robert M. Fetsuga

*Attorney, Agent, or Firm*—J. Sanchelima

[57] ABSTRACT

An improvement for a toilet furniture that includes a seat and a cover hingedly mounted thereon. A latching mechanism housed within the underside of the cover and in cooperative alignment with the inner rim of the seat opening from its underside. A latch member engages the cover and seat assembly when both are in the horizontal position while releasing them when in the vertical position. The latch member includes a J-shape member that is cammingly pushed inwardly when the cover is brought to a substantially horizontal position. Once the end of the J-shape member clears the inner rim, it engages the toilet seat and the only way the cover can be raised is by bringing along the toilet seat.

5 Claims, 2 Drawing Sheets

TOILET SEAT COVER WITH GRAVITY LATCH

BACKGROUND OF THE INVENTION

1. Field of the Invention

The present invention relates to toilet seat covers.

2. Description of the Related Art

Toilet furniture typically includes inter alia a bowl, a seat assembly and a hingedly mounted cover. Women always use the toilet seat while men typically do not use it when they urinate and the seat assembly should be raised to keep the toilet seat dry. However, many times men inadvertently raise only the cover. The present invention solves this problem with a simple mechanism that latches the cover and seat assembly together when in the horizontal position and releases it when in the vertical position thus permitting a user to lower only the seat assembly while forcing the lifting of both.

None of the toilet furniture accessories known to applicant teach the features claimed in the present invention.

SUMMARY OF THE INVENTION

It is the main object of the present invention to provide a seat cover that includes a hook-latching mechanism that prevents men to urinate the toilet seat making it a hygienic sanitary toilet furniture.

It is another object of this invention to provide such a seat cover that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
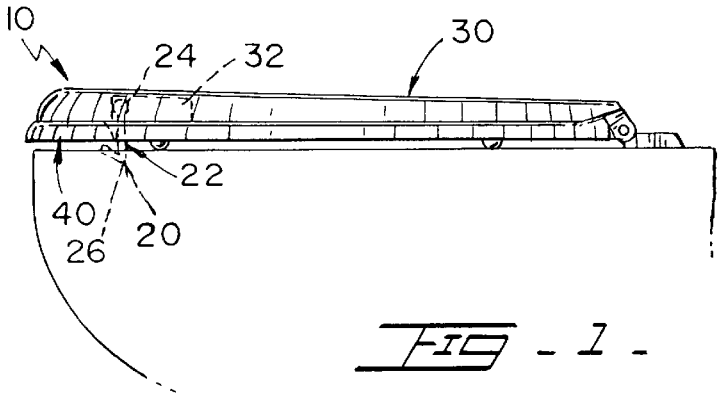
FIG. 1 is a partial elevational view of a toilet furniture with the seat assembly and the cover in the horizontal position.
Figure 2:
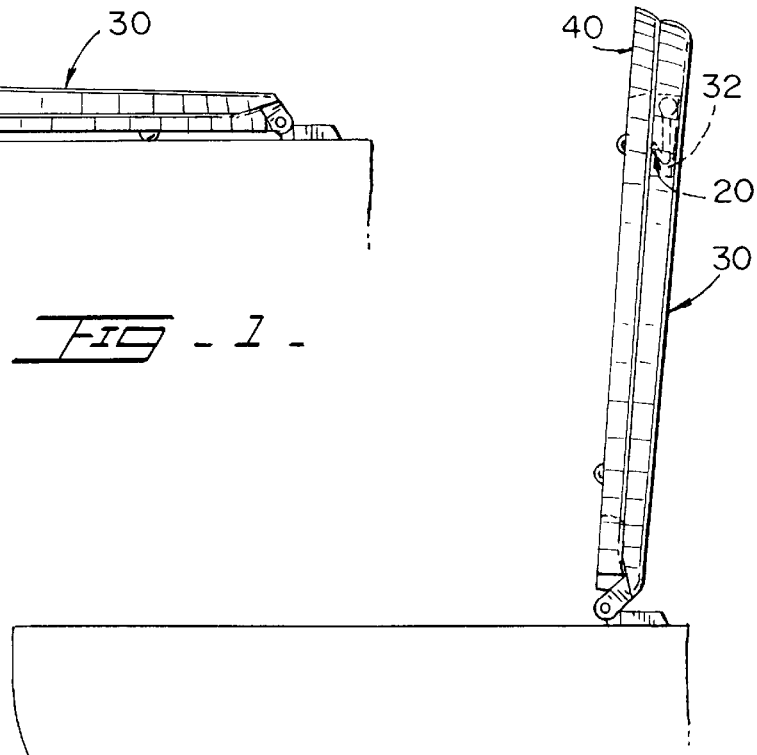
FIG. 2 shows a partial elevational view of the toilet furniture shown in FIG. 1 with both the seat assembly and the cover in the vertical position.
Figure 4:
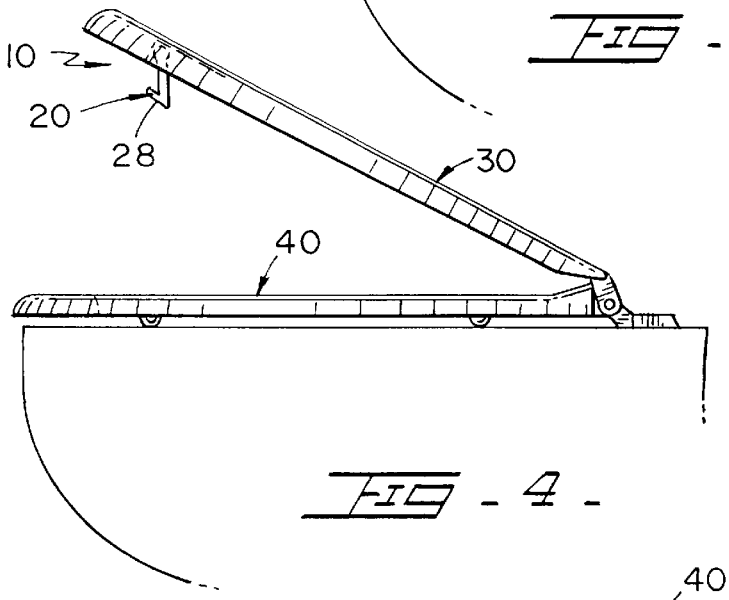
FIG. 4 shows a partial elevational view of the toilet furniture shown in the previous figure with the seat assembly in the horizontal position and the cover being lowered towards the seating assembly and showing the latch member in suspension.
Figure 3:
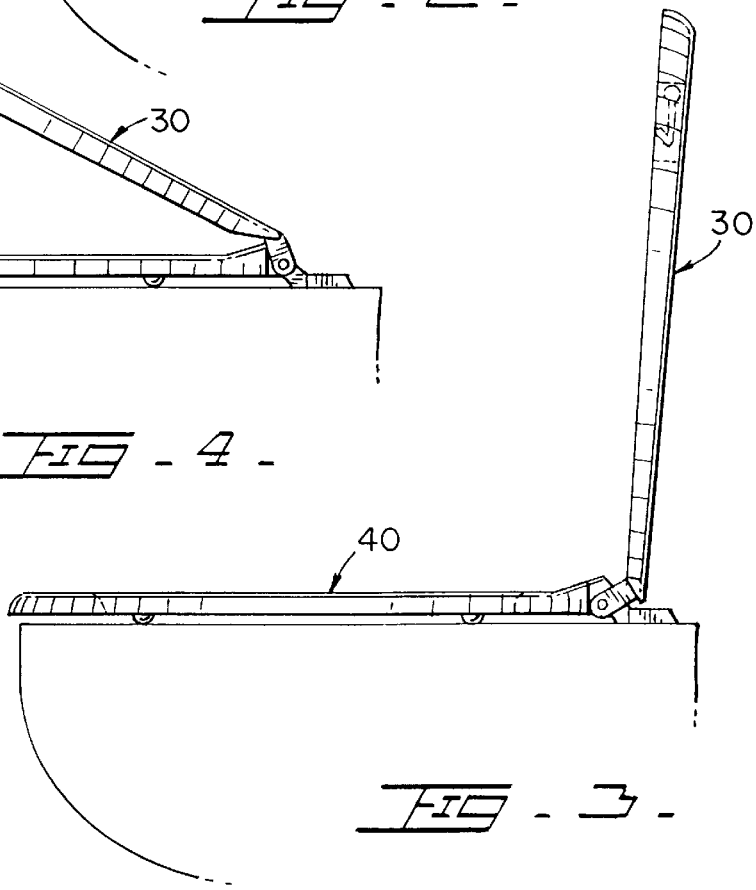
FIG. 3 is a partial elevational view of a toilet furniture shown in the previous figure with the cover in the vertical position and the seat assembly in the horizontal position.
Figure 5:
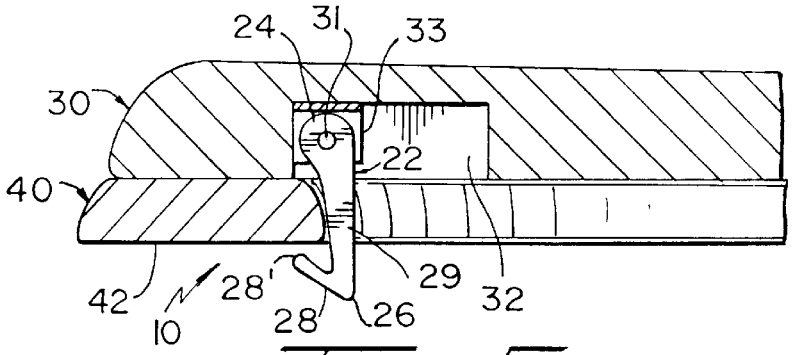
FIG. 5 is a partial cross section of the side view of the toilet seat and cover assembly showing the latching mechanism in horizontal position.
Figure 8:
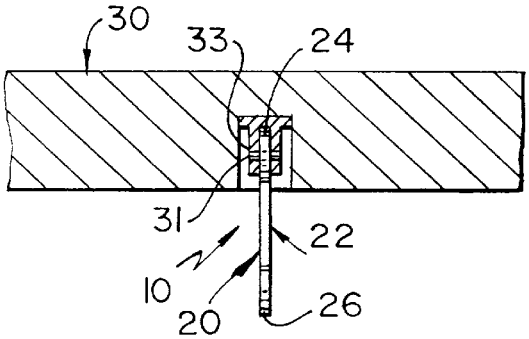
FIG. 8 is a partial cross section of the rear side of the latching mechanism.
Figure 6:
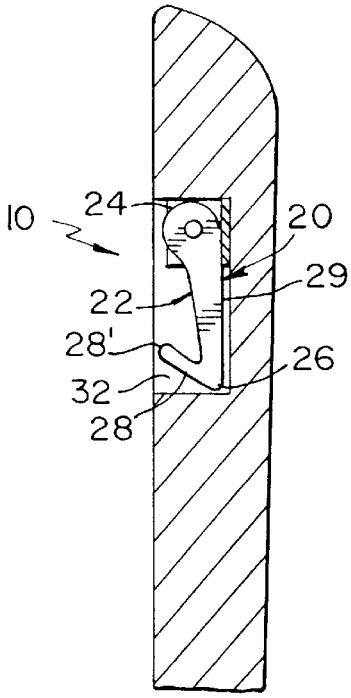
FIG. 6 is a partial cross section of the side view of the cover assembly showing the latching mechanism in vertical position.
Figure 7:
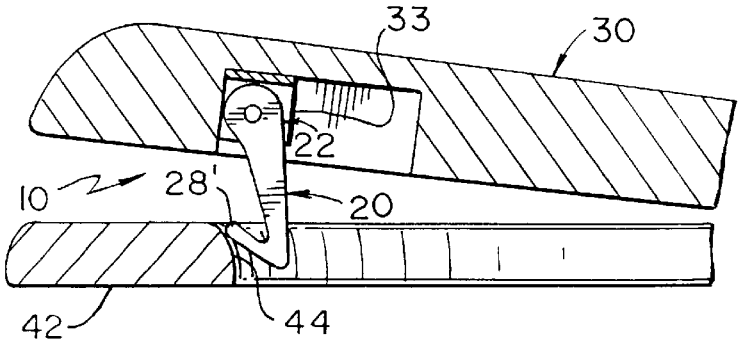
FIG. 7 is similar to FIG. 5 but in process of raising the cover assembly and the latching mechanism disengaging the toilet seat.

Referring now to FIG. 1, it can be seen that the improved toilet seat and cover assembly in the present invention referred with numeral 10 incorporate latching mechanism 20 which is shown in phantom. As best seen in the FIGS. 5; 6 and 7 latch member 22 has a "J" shape with end 24 pivotally mounted within cavity 32. The other end 26 has a substantially straight member 28 that extends at an angle of approximately 45 degrees with respect to shank 29. Latch member 22 pivots about pin 31 mounted to pin support 33 which is completely housed within cavity 32. When raised, curved end 28' comes in contact with underside 42 of seat assembly 40 raising the latter along with cover assembly 30. When in the vertical position (actually cover assembly 30 and seat assembly 40 go beyond a 90 degrees position typically resting on the water tank behind) as shown in FIG. 2, latch member 22 is completely housed within cavity 32 and cover assembly 30 is disengaged from seat assembly 40. After seat assembly 40 has been lowered, and the toilet furniture is not in use, cover assembly 30 is lowered, as shown in FIG. 4, and straight member 28 is brought in contact with curved surface 44 that cammingly forces the former inwardly raising it slightly, as shown in FIG. 7. After end 28' clears underside 42, shank 29 comes to a substantially vertical position as shown in FIG. 5, ready for engaging underside 42 when assembly 30 is lifted.

Therefore a user cannot inadvertently leave seat assembly 40 in the horizontal position while lifting only cover assembly 30.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. In a toilet furniture that includes a bowl over which a seat and a cover for said seat are hingedly mounted at a pivoting position on said bowl and said seat and cover being movable an arc of approximately 90 degrees, and having a substantially horizontal at rest position and a substantially vertical at rest position, said seat includes an opening with an inner rim having a curved surface and an underside and said cover assembly including a cavity cooperatively positioned above said inner rim at the farthest point from said pivoting position and further including a pivotally mounted latch member within said cavity so that said latch member engages said underside when in the substantially horizontal position and releases said underside when in the substantially vertical position, the improvement comprising means for latching said cover to said seat when both are in the horizontal position while releasing them from each other when in the substantially vertical position so that said cover can only be raised with said seat and said seat can be selectively lowered to the horizontal position by itself and with said cover.

2. The improvement set forth in claim 1 wherein said latch member has a "J" shape with first a second ends, and further including pivoting means within said cavity for pivotally suspending said latch member from said first end.

3. The improvement set forth in claim 2 wherein said latch member includes a straight member extending from said second end at an angle with respect to the longitudinal axis of said latch member.

4. The improvement set forth in claim 3 wherein said latch member is cammingly displaced inwardly when said straight member comes in contact with said curve surface.

5. The improvement set forth in claim 4 wherein said latch member is completely housed within said cavity when said cover is in the substantially vertical position.

* * * * *